United States Patent [19]

Ohlson

[11] Patent Number: 4,518,080

[45] Date of Patent: May 21, 1985

[54] CARD, ESPECIALLY ID-CARD INTENDED RETAINER

[76] Inventor: Kurt L. Ohlson, Harvägen 3B, 17800 Ekerö, Sweden

[21] Appl. No.: 530,665

[22] Filed: Sep. 9, 1983

[30] Foreign Application Priority Data

Sep. 10, 1982 [SE] Sweden ..... 8205146

[51] Int. Cl.[3] ..... A45C 11/18

[52] U.S. Cl. ..... 206/39; 40/1.5; 40/10 R; 40/16; 206/37; 206/38

[58] Field of Search ..... 40/1.5, 10 A, 10 B, 40/10 D, 10 R, 27, 152, 156, 360, 611, 622, 625, 626, 16; 206/37, 38, 39, 39.1–39.8, 449, 455, 555, 232; 220/345

[56] References Cited

U.S. PATENT DOCUMENTS

| | | | |
|---|---|---|---|
| 1,373,359 | 3/1921 | Seinecke | 206/39.6 |
| 1,453,071 | 4/1923 | Kleeman | 206/449 |
| 1,526,490 | 2/1925 | Borreson | 40/10 A |
| 1,566,167 | 12/1925 | Petersen et al. | 40/10 A |
| 2,172,528 | 9/1939 | Auer | 40/10 R |
| 2,361,479 | 10/1944 | Joffo | 40/10 R |
| 2,958,971 | 11/1960 | Plettner | 40/152 |
| 3,119,492 | 1/1964 | Burket | 206/455 |
| 3,234,673 | 2/1966 | Cook | 40/10 R |
| 3,804,330 | 4/1974 | Miller, Jr. et al. | 220/345 |
| 4,141,400 | 2/1979 | Mangan | 206/39.6 |
| 4,444,319 | 4/1984 | Sharber | 206/449 |

FOREIGN PATENT DOCUMENTS

| | | | |
|---|---|---|---|
| 0026447 | 7/1956 | Fed. Rep. of Germany | 40/10 R |
| 2257435 | 6/1973 | Fed. Rep. of Germany | 40/10 R |
| 0318704 | 9/1929 | United Kingdom | 40/10 R |
| 1280830 | 7/1972 | United Kingdom | 40/10 A |

*Primary Examiner*—George E. Lowrance
*Assistant Examiner*—Jimmy G. Foster
*Attorney, Agent, or Firm*—Burns, Doane, Swecker & Mathis

[57] ABSTRACT

A retainer (A) for a card, especially ID-card, having a bottom plate (1) and thereto applied or formed opposite edges (2, 3), which are formed with slots (2*a*, 3*a*) and the bottom parts (2*a*', 3*a*') of which are intended to guide opposite edge portions (4, 5) of the card when the card is moved into said retainer. Between said edges (2,3) one or more means (6,7) are arranged to give the card a curvature between the edges. Said means (6,7) is in the form of two parallel ridges formed in the bottom plate (1) and said ridges (6,7) are omitted at certain portions (8,9). Said portion (8,9) is adjacent but at a distance from stop means (10,10*a*11,11*a*) in the retainer for the movement of the card (B). Said stop means (10,11) for the card is in the form of a rim having a central notch or recess (10*a*) and between the stop means and the portion are, in the direction of movement for the card, arranged wedge formed ridges (6*a*,7*a*).

6 Claims, 6 Drawing Figures

CARD, ESPECIALLY ID-CARD INTENDED RETAINER

TECHNICAL FIELD

The present invention refers to a retainer or a holder and especially to such a retainer that is designed or designated to hold a card. Said card must, for different reason, easily be able to be taken out of said retainer or easily be moved into said retainer.

A retainer is especially suitable to be used for holding an identification card, called ID-card. Said retainer may also be used when the ID-card has a special code thereon. With such an ID-card it will be possible to easy pass though such doors, where its locking mechanism is controlled by said code, use it as an access card for operating complicated machines, use it as a ticket when passing through passage gates in traffic systems and so forth.

A retainer, of a construction mentioned above, may consists of a bottom plate and thereto applied or formed opposite edges, which are formed with slots, intended to guide opposite edge portions of the card when said card is displaced or moved into said retainer or out of said retainer.

PRIOR ART

It is previously known a plurality of retainers or holders of a construction mentioned above. Common for these retainers are however that they are either formed to hold plane cards only, which means that a selfbended card hardly can safely be hold by the retainer, or formed with complicated devices, which has as a result that said card hardly can be taken away from the retainer.

A common disadvantage with these previously known simply constructed retainers is that they can not sufficiently secure the card in the retainer and in more complicated constructions no means is shown to easily take the card from or out of the retainer, when this is needed.

EVALUATION OF THE PRESENT INVENTION

Technical Problems

It is thus a qualified technical problem to construct a retainer for a card, which is so designed, that it easily and effectively can hold the card in the retainer in combination with the fact that said card easily can be taken away from the retainer, when this is needed. At the same time the production cost of the retainer must be low, and the production shall especially be a massproduction in a plastic moulding tool.

The problem of holding a card firmly, for example an ID-card, in a retainer is especially hardsolving because the ID-card has a plastic coating on each side, which makes the card glossy. Moreover the ID-card is normally produced with a magnetic tape, and this tape may not be weared out when said card is moved into and out of the retainer.

It is further a qualified technical problem to arrange so that retainers of the above mentioned construction easily may be attached around a neck, be hold of a hook using a band, especially a circular plastic cord, and that means is provided to make it possible to hang the retainer in two different positions.

It is further a desire that a retainer of the above mentioned construction not only shall be able to be hold by a cord but also to be able to be hold by a seprate and detachable by a clamping force acting holding means and this means shall be able to hold the retainer adjacent the upper part of a coat (coat collar), a pocket or the like in two different positions.

SOLUTION

The present invention is based upon a retainer or holder for a card, especially ID-card, having a bottom plate and thereto applied or formed opposite edges, which are formed with slots, intended to guide opposite edge portions of the card, when said card is displaced or moved into said retainer or out of said retainer.

The present invention is further based upon the fact that between the edges one or more means are arranged to give the card a small curvature. The invention suggests that said means preferably shall be in the form of two parallel oriented ridges formed in the bottom plate and centred between the edges. Moreover said ridges shall be omitted at some portions, and these portions shall be adjacent but at a distance from stop means formed in the retainer, which stop means is intended to firmly hold the card in the retainer.

This stop means for the card is in the form of a border or a rim having a central notch or recess.

Between the stop means and said portion are, in the direction of movement for the card, arranged small wedge formed ridges. This allows the card to be pressed down within the area of said portions under the upper part of the ridges and this pressing of the card bends the edge of the card up so that edge easily may be lifted over the stop means.

The present invention also gives advice of a first hole, formed in a corner of the retainer, for cooperation with a band or a cord and its end portion is threaded through said first hole and clamped in a constriction, formed between the first hole and a second hole or recess. The constriction is formed by two wall portions having an angle of 30°.

The retainer according to the invention has also a third hole, formed in the bottom plate, in order to cooperate with a separate and detachable by clamping force acting holding means for a coat, a pocket or the like.

ADVANTAGEOUS

The advantage with a retainer according to the present invention are that a card, even if it is an ID-card having plastic covered surfaces, easily can be moved into the retainer. When the card is moved to its final position in the retainer first opposite edges of the card are facing stop means and other opposite edges are guided by slots, and the corners of the card will, due to the caused curvature of the card, be pressed towards said stop means or be pressed against surfaces adjacent said stop means. which means that said card in said position can not be taken out by a simple movement. The card will not leave the retainer if the retainer is dropped.

If the card, consciously shall be taken away from the retainer by pulling it out of the retainer than the first edge portion must be bent upwards leaving its cooperation with the stop means. Said first edge portion is than to be gripped and the whole card can be moved out of the retainer. The first edge portions may be bent upwards by simply pressing a portion of the card, adjacent said portion where the ridges were omitted, slightly towards the bottom plate.

The most significative features of the present invention are stated in the characterizing part of the succeeding claim 1.

BRIEF DESCRIPTION OF THE DRAWINGS

A preferred embodiment, having the significative features of the present invention, of a retainer for a card, especially an ID-card, shall be described more in detail with reference to the attached drawing, in which.

DESCRIPTION OF THE PREFERRED EMBODIMENT

Figure 1:
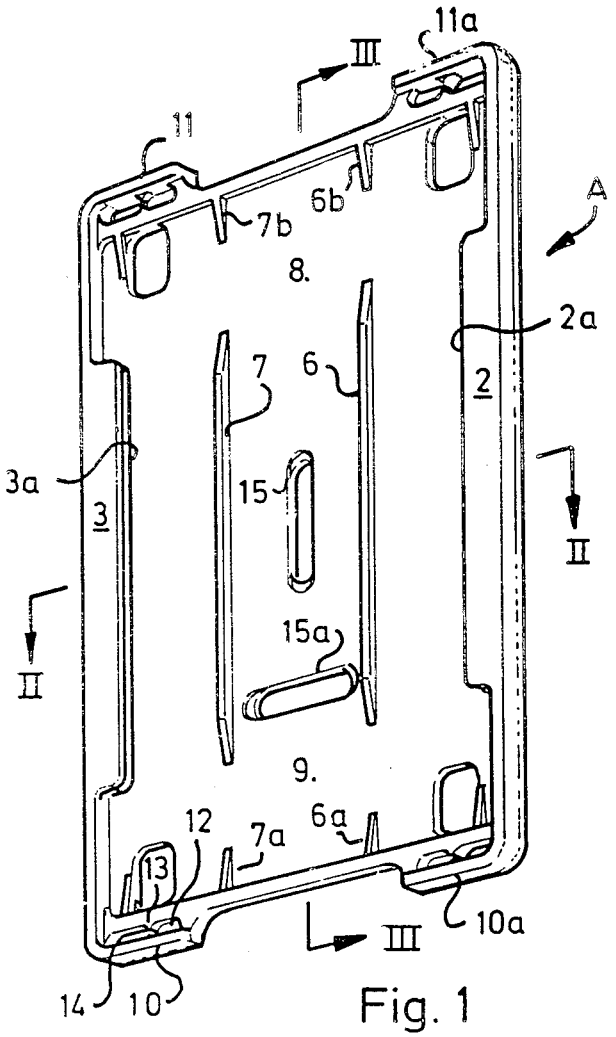
FIG. 1 shows the retainer in perspective view.
Figure 3:
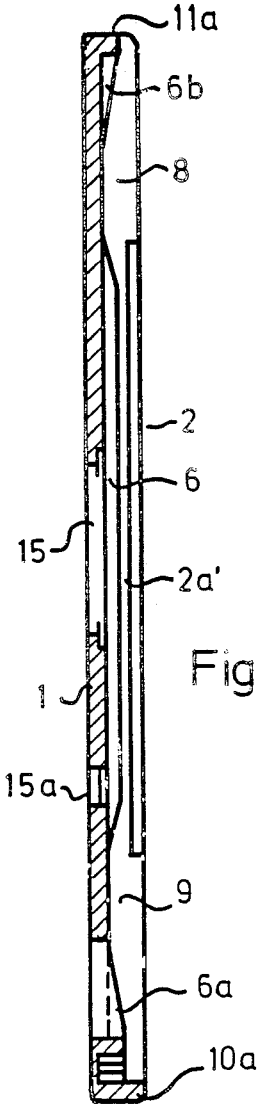
FIG. 3 shows a section III—III of the retainer according to FIG. 1.
Figure 2:
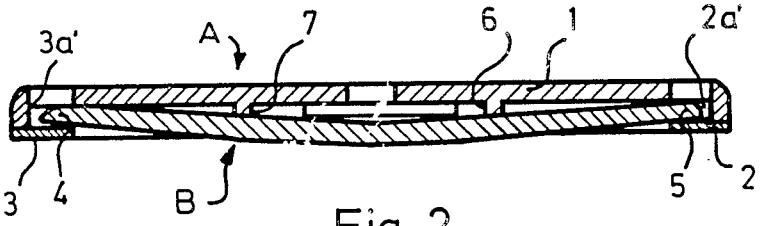
FIG. 2 shows a section II—II of the retainer according to FIG. 1.

With reference to FIG. 1 it is shown a perspective view of a retainer or holder, intended for holding a card, according to the present invention and this retainer is especially designed for holding an identification card or ID-card. The retainer "A" is thus especially designed to hold an ID-card "B", which is only shown in FIG. 2, due to elucidation or clarity. The retainer "A" comprises a bottom plate 1 and thereto applied or formed opposite arranged edges 2, 3, which are formed with slots 2*a*, 3*a* and its bottom 2*a'*, 3*a'* are intended to serve as guides for opposite edge portions 4, 5 of the card "B", shown in FIG. 2 and named second edge portions. These edge portions 4 and 5 are thus guided in the bottoms of the slots when moving the card into and out of the retainer.

Between the edges 2 and 3 is in the retainer one or more means arranged. These are formed to cause a small curvature to the card "B" between the second edge portions and these means have been given the reference numerals 6 and 7 and are in the form of two parallel oriented ridges formed integrally in the bottom plate. The ridges 6 and 7 are arranged to extend from the bottom plate 1 a distance essentially corresponding to half the thickness of the card "B".

Essential for the present invention is further that said ridges 6 and 7 are omitted at some portions, having the reference numerals 8 and 9, and these portions shall be adjacent but at a distance from stop means 10, 10*a* resp. 11, 11*a* formed in the retainer, and which stop means is intended to secure the card in the retainer and prevent it from a movement out of the retainer. The parts of the card "B", which are intended to face or cooperate with said stop means are named first edge portions. The distance between the stop means 10 and 11 corresponds to or slightly exceeds the distance between opposite first edge portions for the card. The stop means 10 is in the form of a border or rim, formed to face the edge surface of the card, and having a central notch or recess 10*b* and between the stop means 10 and the portion 9 are, in the direction of movement for the card, arranged small wedge formed ridges 6*a*, 7*a*. Corresponding ridges adjacent the stop means 11 have been given the reference numerals 6*b* and 7*b*.

By this embodiment the card may be pressed downwards and passing the ridges 6, 7 resp. 6*a*, 7*a* within the portion 9, which pressing beneath the upper surface of the ridges causes the first edge portion adjacent the stop means 10 to a lifting movement and said edge is raised above said stop means 10. The card "B" can be pressed downwards under the ridges 6, 7 with a thum acting on the card area adjacent portion 9 and with a finger and said thum said edge of the card can be gripped with the finger from the under side.

A first hole or recess 12 is formed in at least one corner of the retainer "A" in order to cooperate with a band or a cord with circular cross-section, and an end portion is threaded through said first hole 12 from the under side in FIG. 1 and clamped in a constriction 13, formed between said first hole 12 and a second hole 14 or recess.

In case of a plastic cord is used, said cord is cut by heated tools, which means that the end portion gets a stiffer ability It is suggested that said stiffer portion shall be placed in said second recess 14 and by forming said constriction from two wall portions, arranged at an angle, especially having an angle of 30°, a clamping force is acting on said end portion placed in the second recess 14.

The embodiment according to FIG. 1 shows four such recesses for the cord, one in each corner of the retainer, and the retainer can be held in two different positions by the use of one cord and its holding means.

Figure 4:
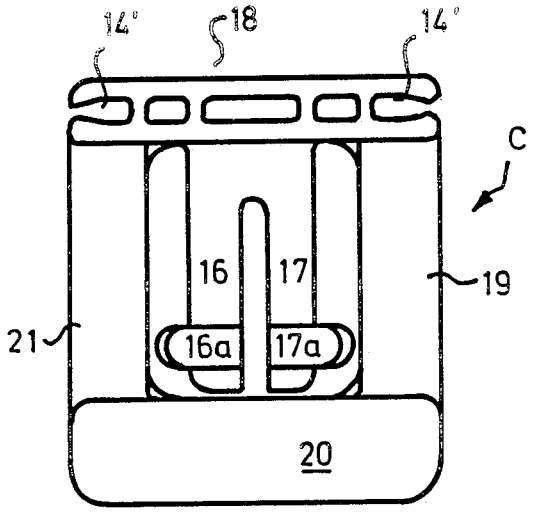
FIG. 4 shows in plan view a separate and detachable means, which may by clamping force hold the retainer to a coat, a pocket or the like, FIG. 5 shows the means according to FIG. 4 in a side view.
Figure 5:
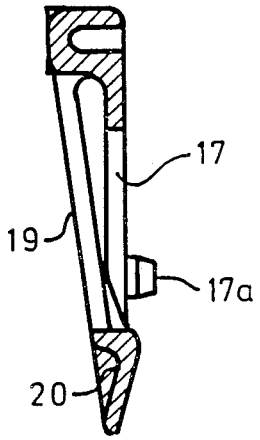
Figure 6:
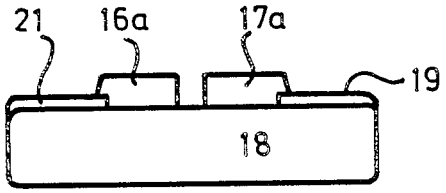
FIG. 6 shows the means according to FIG. 4 in a section view.

It is suitable to be able to hold the retainer to a coat and its collar, a pocket or the like and for this reason the present invention gives advice of a design where the bottom plate 1 has a central first recess 15 and a second identical recess 15*a*. These recesses 15, 15*a* are formed to cooperate with a separat and detachable by clamping force acting holding means, shown in FIG. 4, and the complete means has been given the reference "C". The means "C" has two arms 16, 17, which are springacting to the shown positions, and the free end has hooks 16*a* and 17*a* intended for cooperation with the recesses 15 and 15*a*. The arms 16, 17 are united to a portion 18, from which extends a U-shaped clip, having parts 19, 20, 21 and these parts are pressed towards the back of the bottom plate 1 of the retainer.

It is to be noted that when the hooks 16*a* and 17*a* are in cooperation with the recess 15 these hooks 16*a* and 17*a* will be placed behind the card "B" and between the rigdes 6 and 7 and thus these hooks do not interfere or stop the movement of the card "B".

In case the separate and detachable by clamping force acting holding device "C" only shall hold a card, which means that a clamping force is acting between the parts 19, 20 and 21 and the arms 16 and 17, it is suggested that in portion 18 is formed first and second recesses 14' identical to the recesses in the retainer "A".

When a card "B" shall be moved into the retainer "A" along the slots 2*a*, 3*a* its foremost edge portion is placed in the portion 8 and by the movement into the slots 2*a* and 3*a* and the ridges the card is curvated with a convex surface up. When the corners of the foremost edge portion are pressed towards the stop means 10, 10*a* the corners of the rear edge portion is moved to cooperation with the stop means 11, 11*a*.

The card "B" is now secured by aids of stressing forces.

A pressure acting upon card "B" adjacent portion 9 is firstly straightening up the end portion of the card and a further pressure raises the edge portion from the stop means 10, 10*a* and even above these. The raised edge portion can easily be gripped and the card may be moved out of the retainer.

The invention is not restricted to the shown embodiment but may be amended within the idea stated in the succeeding patent claims.

What is claimed is:

1. A retainer for a card, especially ID-card, provided with a bottom plate including opposite edges defining facing slots, said bottom plate and said opposite edges connected by bottom parts which guide opposite edge portions of the card when the card is inserted into said retainer, wherein two parallel ridges are provided on said bottom plate so as to give the card a curvature between said opposite edges; said ridges being discontinuous between opposite end portions of said plate positioned transversely to said opposite edges; said opposite end portions defining stop means for preventing movement of the card.

2. A retainer according to claim 1, characterized in, that said stop means (10,11) for the card is in the form of a rim having a central notch or recess (10*a*) and between the stop means and the portion are, in the direction of movement for the card, arranged wedge formed ridges (6*a*,7*a*).

3. A retainer according to claim 1, characterized in, that the card is pressable downwards beneath the ridges (6,7) within said portion and can be lifted over the stop means.

4. A retainer according to claim 1, characterized in, that a first hole or recess (12) is formed in at least one corner of the retainer intended for cooperation with a band or a cord, its end is threaded through said first hole (12) and is secured in a constriction (13) between the first hole (12) and a second hole or recess (14).

5. A retainer according to claim 1, where in a constriction is formed by two wall portions having an angle of about 30°.

6. A retainer according to claim 1, characterized in, that a third hole (15) is formed in the bottom plate, in order to cooperate with a separate and detachable by clamping force acting holding means (C).

* * * * *